United States Patent [19]

March

[11] Patent Number: 4,776,552

[45] Date of Patent: Oct. 11, 1988

[54] BOOK REST

[75] Inventor: David March, New York, N.Y.

[73] Assignee: Thomson Leeds, Co., New York, N.Y.

[21] Appl. No.: 109,176

[22] Filed: Oct. 16, 1987

[51] Int. Cl.[4] ..... A47G 1/24

[52] U.S. Cl. ..... 248/455; 248/461

[58] Field of Search ..... 248/455, 456, 460, 441.1, 248/446, 450, 461, 472, 473, 174, 166

[56] References Cited

U.S. PATENT DOCUMENTS

| | | | |
|---|---|---|---|
| 2,003,746 | 6/1935 | Headington | 248/456 X |
| 2,224,530 | 12/1940 | Weinstein | 248/456 |
| 2,597,206 | 5/1952 | Tracy | 248/446 |
| 3,029,548 | 4/1962 | Braha | 248/455 |
| 3,315,936 | 4/1967 | Dautch | 248/174 X |
| 3,381,928 | 5/1968 | White | 248/455 |
| 3,773,154 | 11/1973 | Mitchell | 248/455 X |
| 3,785,605 | 1/1974 | Parekh | 248/455 |
| 4,116,413 | 9/1978 | Andersen | 248/455 X |
| 4,150,807 | 4/1979 | Manso | 248/460 X |
| 4,674,724 | 6/1987 | Gaudet | 248/459 |

*Primary Examiner*—Ramon O. Ramirez

*Attorney, Agent, or Firm*—Howard C. Miskin

[57] ABSTRACT

A collapsible book rest includes a first panel having a transversely medially located rectangular opening and divided into similar side sections by a medially longitudinally extending self hinge, a rectangular second panel self hinged to the rear edge of the opening and divided into side by side and end to end sections by a transverse self hinge and a medial longitudinal self hinge colinear with the first panel longitudinal hinge. Follower slides project transversely from the front corners of the second panel and slidably engage tracks along the opening side edges and separably engage detents along the track to releasably lock the first panel sections in coplanar positions and the second panel in a depending dihedral defining position.

13 Claims, 3 Drawing Sheets

BOOK REST

BACKGROUND OF THE INVENTION

The present invention relates generally to improvements in book support devices and it relates particularly to an improved collapsible book rest.

In studying and reading large books such as dictionaries, reference books, encyclopedias and other large volumes it is highly desirable to support the open book in an inclined manner to expedite the reading and examining of the open book and minimize the discomfort and increase the convenience to the reader. To this end many devices have been heretofore proposed and employed to support the open book at an optimum angle for reading and observation either on a pedeastle or on a table or other platform. However the devices for this purpose heretofore available have been awkward, bulky, expensive and often complicated structures inconvenient to package, store, dispense and ship and otherwise leave much to be desired.

SUMMARY OF THE INVENTION

It is a principal object of the present invention to provide an improved book support device.

Another object of the present invention is to provide an improved book rest for supporting a book for reading at an optimum inclination.

Still another object of the present invention is to provide an improved book rest which is oollapsible to a highly compact condition to facilitate the handling dispensing, shipping and storing thereof and which is easily and rapidly extended to its open operable condition without the use of tools.

A further object of the present invention is to provide an improved collapsible book rest of the above nature which is reliable, rugged, of attractive appearance, highly convenient and of great versatility and adaptability.

The above and other objects of the present invention will become apparent from a reading of the following description taken in conjunction with the accompanying drawings which illustrate a preferred embodiment thereof.

A collapsible book rest in accordance with the present invention includes a book supporting platform member having a medial opening and divided into opposite side sections by a medial longitudinal self hinge so that the sections may be swung between an open coplanar and closed overlapping positions, a prop member hinqed to the opening rear edge and swingable between an advanced depending position and a retracted position registering with the platform member opening and releasable locking means maintaining the platform member in its open position and the prop member in its advanced position.

In accordance with a preferred embodiment of the present invention the book rest is an integrally formed unit and the platform member is a flat first panel divided into the opposite side sections by a self hinge, the opening therein being rectangular and medially located. The prop member is a rectangular second panel nestable in the first panel opening and is hinged along its rear edge to the opening rear edge by a self hinge. A transverse self hinge and a medial longitudinal self hinge divide the second panel into four side by side and end to end sections of equal width with the rear sections being shorter than the front sections. Tracks are formed along the front side edges of the first panel opening and follower slides project from the front corners of the second panel and separably slidably engage the tracks. Detents are formed on the tracks rear portions and are separably engagable by recesses in the guide slides to releasably interlock the panels with the first panel in an open position and the second panel folded along the transverse hinge and depending from the first panel.

The book rest in its collapsed condition is flat and compact and is easily rapidly extended and releasably locked in its erected position, the folded second panel functioning as a stable and reliable prop and the book rest firmly supporting a heavy book in open position at an optimum angle for reading, observation and study.

DESCRIPTION OF THE PREFERRED EMBODIMENT

Figure 1:
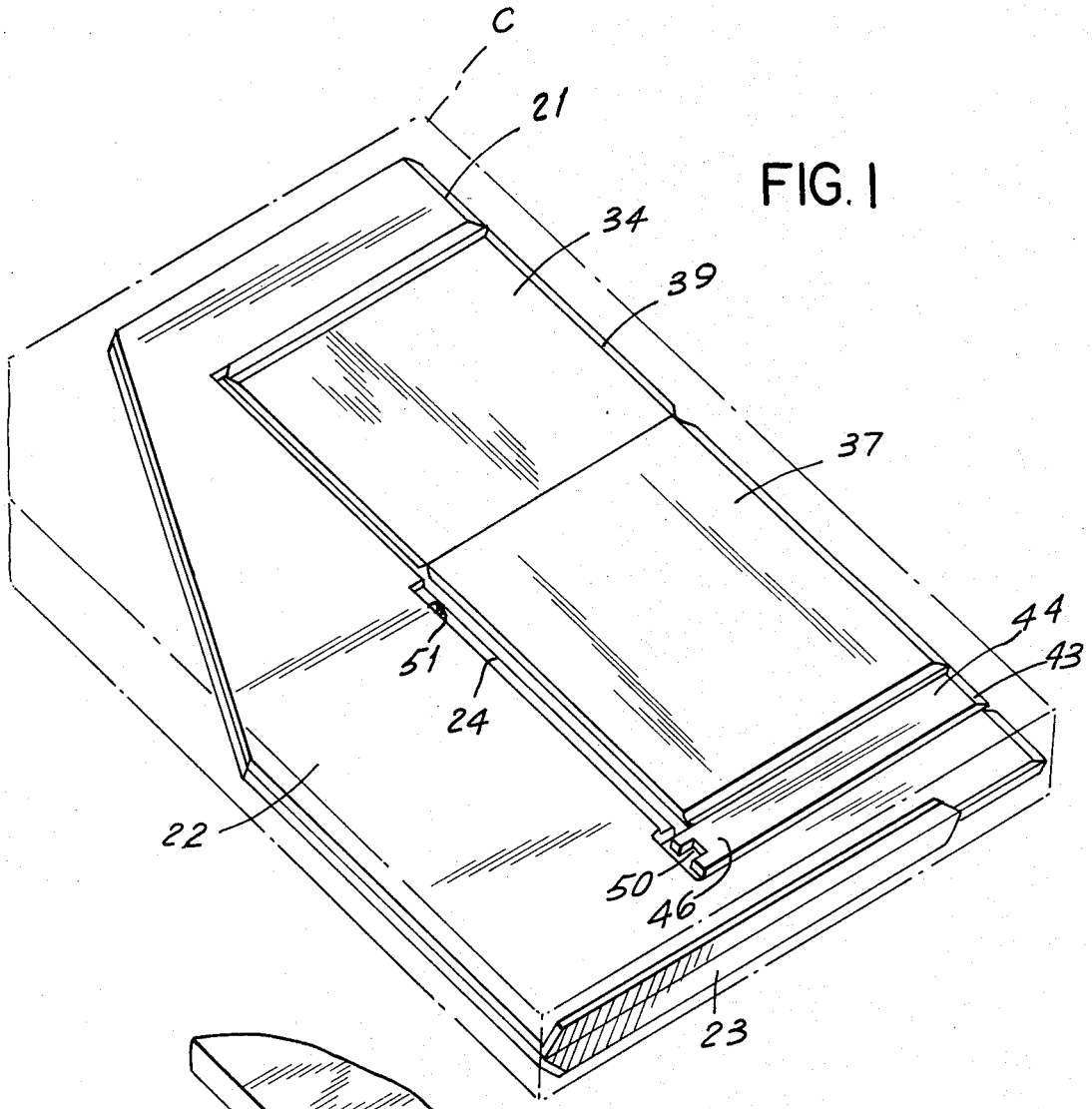
FIG. 1 is a top perspective view of a book rest in accordance with the present invention shown in a collapsed condition housed in a shipping container illustrated by broken line.
Figure 3:
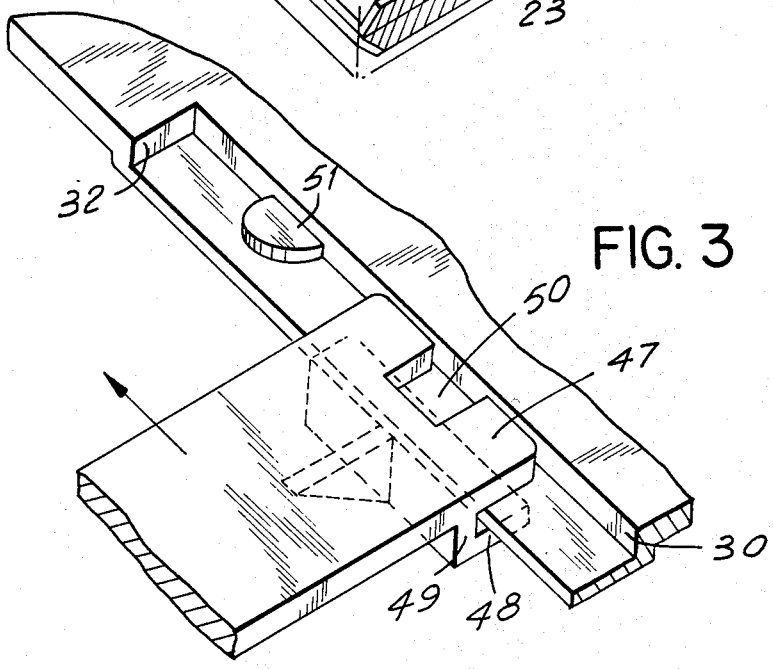
FIG. 3 is a fragmentary enlarged perspective view of a portion of the book rest shown in a condition in the process of erection.

Referring now to the drawings which illustrate a preferred embodiment of the present invention, the reference numeral 10 generally designates the improved book rest which is formed as an integral unit by injection molding or other process of a flexible thermoplastic organic polymeric material, for example a polyolefin, polyvinyl chloride or other suitable material. The book rest 10 may be of any desirable color and decorated.

The book rest 10 includes a first panel 11 defining a book supporting platform member and a second panel 12 which in its extended position defines a prop member. First panel 11 has parallel front and rear edges 13 and 14, rear edge 14 being shorter than front edge 13, parallel front side edges 16 and rear side edges converging from the rears of the front side edges to respective ends of rear edge 14. First panel 11 has formed therein a rectangular opening 18 which is symmetrical to the medial longitudinal axis of first panel 11 and whose front and rear edges 19 and 20 are proximate first panel edges 13 and 14 respectively. A live or self hinge 21 extends along the length of the medial longitudinal axis of first panel 11 dividing the panel into similar side-by-side side panel sections 22 which are relatively swingable about self hinge 21 between an open coplanar position and a closed position in which side sections 22 are in overlapping back to back superposition. Upwardly projecting flanges 23 are formed along panel front edge 13 and have transversely spaced inner edges.

A track defining flat horizontal lip 24 is located along and below each of the front side edges 26 of opening 18 and extends from a point between opening front and rear edges 19 and 20 to a point short of front edge 19. A short transverse recess 29 is formed between the front end of each track 24 and opening front edge 19. Each track 24 is joined to the opening respective side edge by a longitudinal narrow depending inner wall 30, extending for the length of the track 24 and a depending transverse end wall 32 located at the rear end of track 24.

The second panel 12 is of rectangular configuration similar in shape to and of slightly lesser dimensions than that of opening 18 and is connected along its rear edge by a self hinge 33 to the rear edge 20 of opening 18 permitting the swinging of second panel 12 between a retracted position registering with opening 18 and coplanar with first panel 11 and an advanced position depending below first panel 11. Second panel 12 is divided into four side-by-side and end-to-end rectangular sections 34, 36, 37 and 38 by a longitudinal medial self hinge 39 and a transverse self hinge 40 permitting the folding downwardly of the second panel sections along the transverse hinge 40 toward top face to top face contraction and along the longitudinal hinge to back to back superposition. Panel sections 34, 36, 37 and 38 are of equal widths and panel sections 34 and 36 are somewhat shorter than panel sections 37 and 38. Extending along and connected to the freefront edges of panel sections 37 and 38 by a transverse self hinge 41 is a strip 42 divided by a medial self hinge 43 into opposite side sections 44. Each strip section 44 terminates at its outer end in a follower slide 46 which slidably engages a respective track 24. Each slide 46 includes upper and lower parallel rectangular legs 47 and 48, upper leg 47 being coplanar with the respective adjacent strip section 44 each pair of legs 47 and 48 being joined by an inner vertical connecting wall 49 and embracing a respective track 24.

Formed in each slide upper leg 47 is a transversely open ended locking recess 50. A semicircular locking detent 51 is located proximate each track end wall 32 and projects inwardly from track wall 30 along the top face of track 24. The diameter of detent 51 is less than the length of recess 50 whose transverse dimension is less than the radius of detent 51. Thus with the advance of slide 46 rearwardly the detent 31 snap engages recess 50 when slide 46 is adjacent wall 32 to releasably retain the slide in its rear advanced position.

In the operation and application of the improved book rest 10, in its collapsed position such as for storage in a flat carton C as shown in FIG. 1, the first panel 11 is folded along hinge 21 to bring the panel side sections 22 in superimposition. The second panel 12 and strip 42 are folded along hinges 33, 39, 40 and 41 to bring the second panel and strip side sections in coplanar relationship with respective first panel side sections and in back to back superpositions, the strip side sections 44 being adjacent opening front edge 19 and slides 46 being disengaged from tracks 24 and registering with recesses 29.

Figure 2:
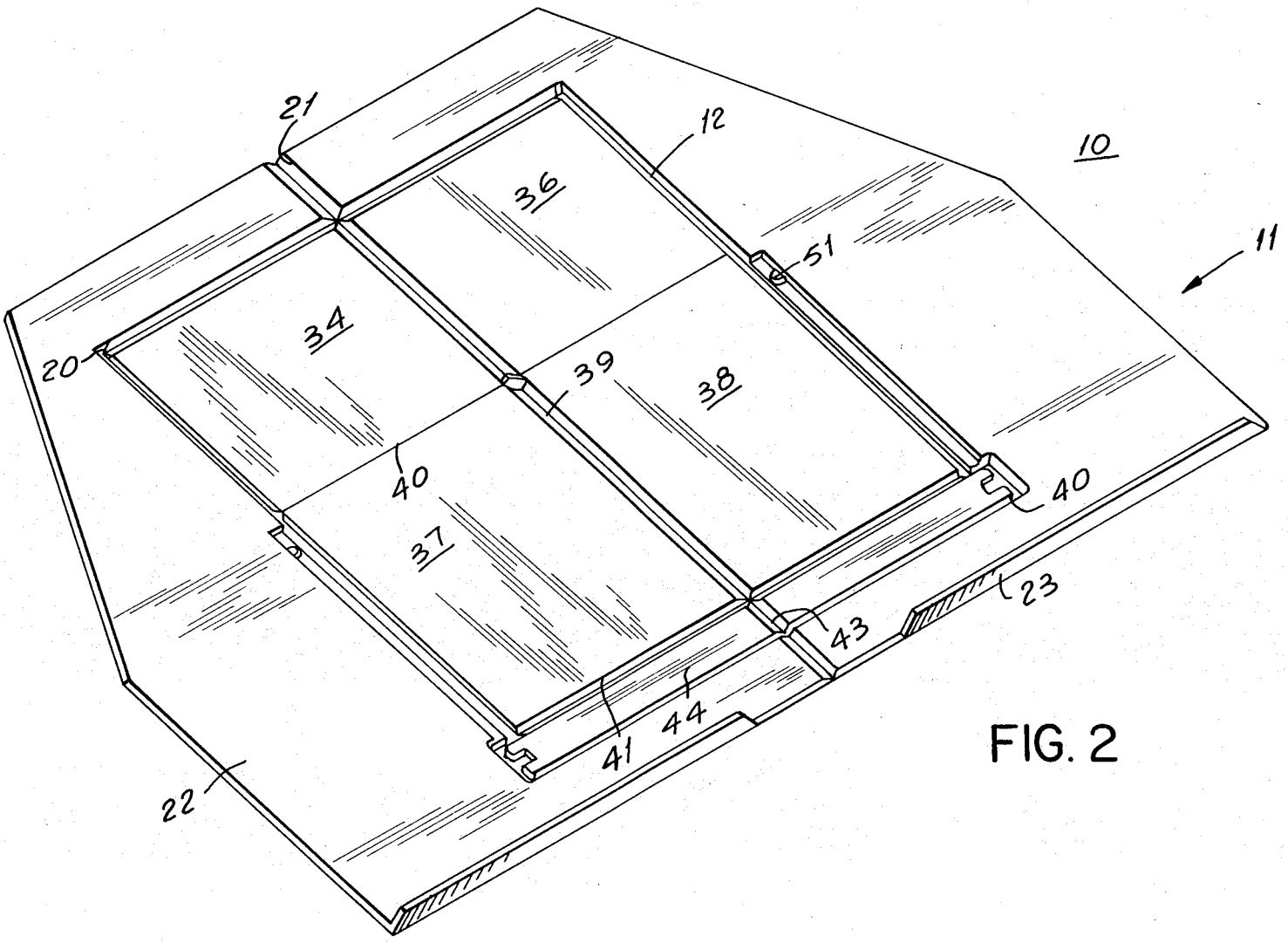
FIG. 2 is a top perspective view of the book rest illustrated in partially extended condition.
Figure 4:
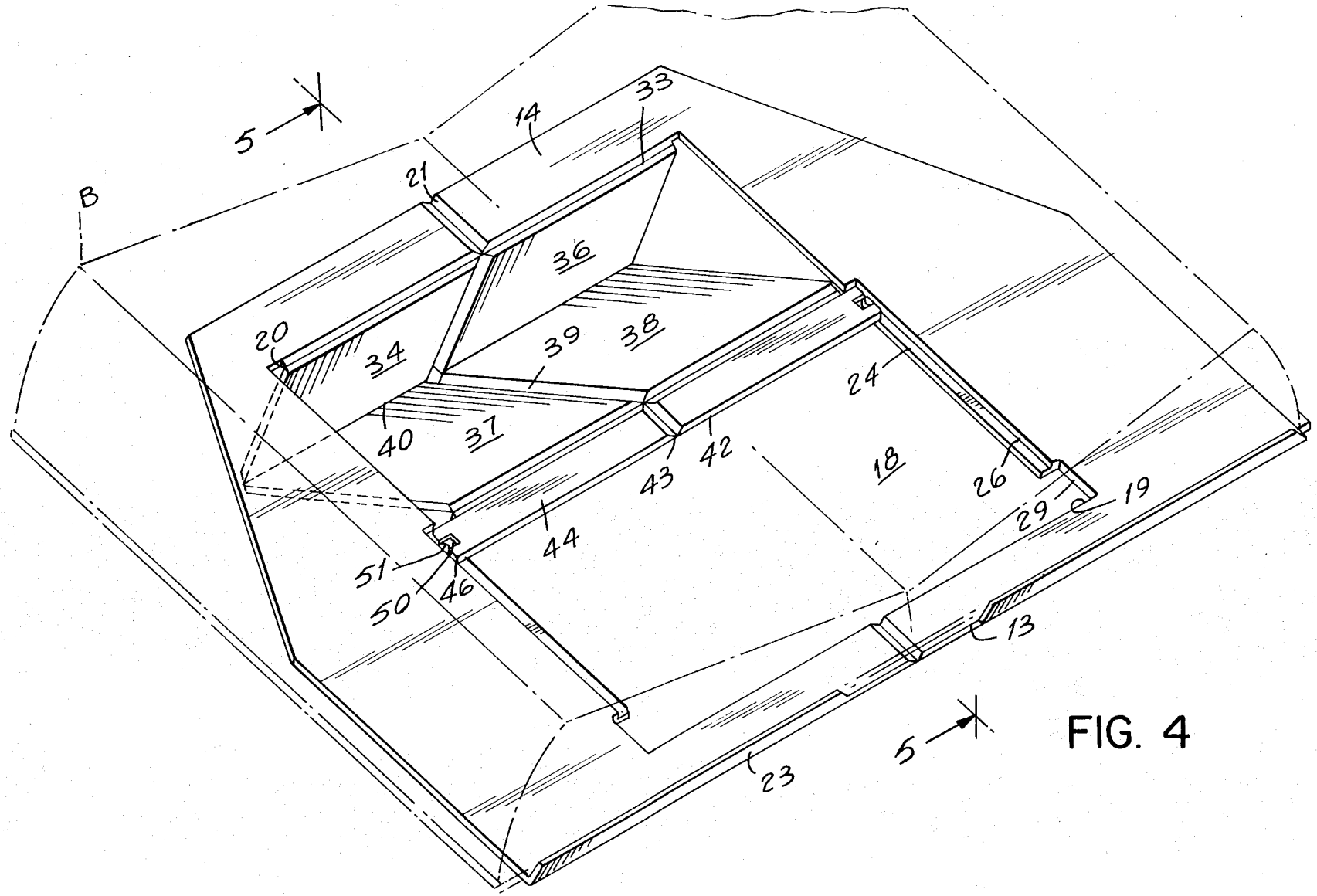
FIG. 4 is a front perspective view of the book rest in fully erected locked condition illustrated supporting an open book shown by broken line.
Figure 7:
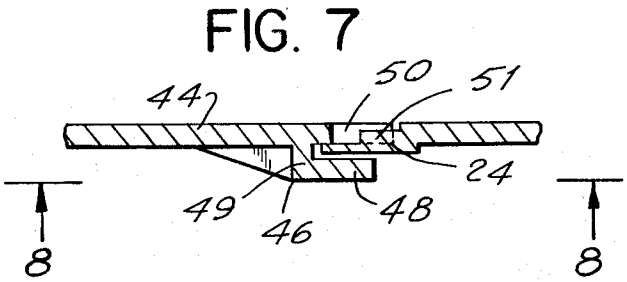
FIG. 7 is a sectional view taken along line 7—7 in FIG. 6.
Figure 8:
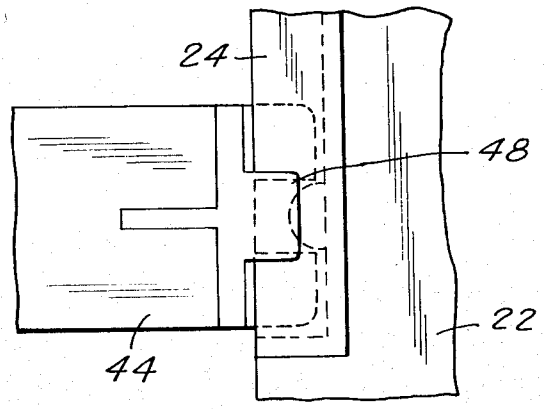
FIG. 8 is a bottom plan view taken from line 8—8 in FIG. 7.
Figure 6:
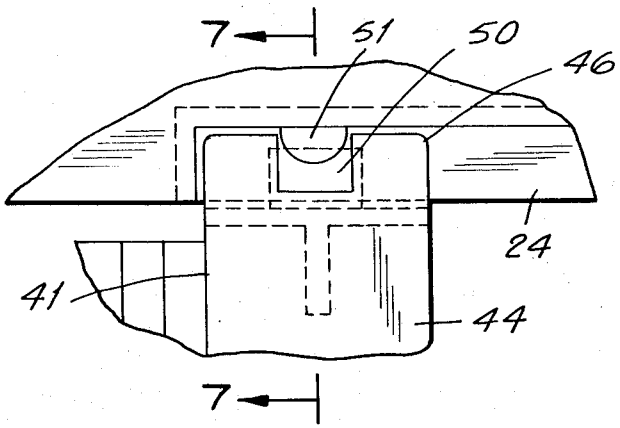
FIG. 6 is a fragmentary plan view taken from line 6—6 in FIG. 5.
Figure 5:
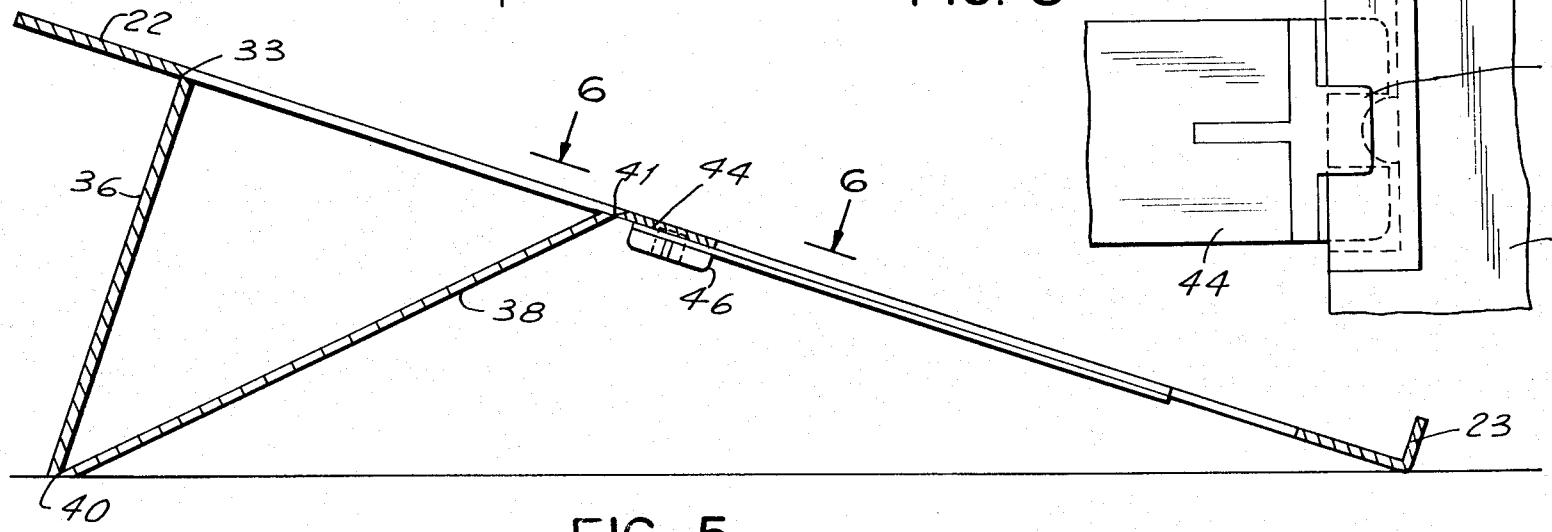
FIG. 5 is a sectional view taken along line 5—5 in FIG. 4.

To erect the book rest it is first swung about the longitudinal hinges to an open position in which the panel sections and slide strips are coplanar, as shown in FIG. 2, the second panels are depressed and folded along hinge 40 and with the rearward advance of strip 42 slides 46 are manipulated into engagement with tracks 24. The slides 46 and strip 42 are then slid rearwardly until slides 46 reach their rearmost position along tracks 24 the slide recesses 50 releasably engaging respective detents 51. Attendant to the rearward movement of slides 46 and strip 42 the second panel folds downwardly along hinge 40 to form a dihedral shaped prop depending from the rear portion of the open front panel 11, the transverse hinges 33 and 41 permitting the swinging of the panel sections about their outer end transverse edges. It will be noted that in the book rest erect position the second panel rear section is downwardly rearwardly inclined when the book rest is located on a horizontal support as shown in FIG. 5. A book B may rest on the inclined open first panel and restrained by flange 23 from downwardly sliding.

The book rest may be collapsed by proceeding in an opposite manner employed in erecting the book rest, as described above.

While there has been described and illustrated a preferred embodiment of the present invention it is apparent that numerous alterations, additions and omissions may be made without departing from the spirit thereof.

I claim:

1. A collapsible book rest comprising a first panel having an opening formed therein and divided into side by side sections by a longitudinally extending first hinge, said sections being swingable about said first hinge between an open coplanar position and a closed overlapping position, a second panel of no greater dimensions than said opening and joined along its rear edge to the rear edge of said opening by a second hinge and divided into side by side sections by a third hinge colinear with said first hinge and subdivided into longitudinal end to end sections by a transverse fourth hinge, said second panel sections being swingable about said second, third and fourth hinges between an advanced position with said second panel forming a dihedral angle about said fourth hinge and depending from said first panel and a retracted position registering with said opening, said retracted second panel being foldable about said third hinge to a closed position with the side by side sections thereof overlapping with the closing of said first panel and means for releasably retaining said book rest in an erected position with said first panel open and said second panel in its advanced position.

2. The book rest of claim 1 wherein the side edges of said opening are parallel and longitudinal and including guide means longitudinally slidably coupling the front edge of said second panel to said opening side edges.

3. The book rest of claim 2 wherein said guide means includes tracks extending along the forward portions of said opening side edges and follower slides projecting transversely from the front corners of said second panel and slidably embracing said tracks.

4. The book rest of claim 3 including transversely extending strips hinged to the front edges of said second panel front section front edges and terminating at their outer ends in said follower slides.

5. The book rest of claim 3 wherein said retaining means comprises a detent located on each of said tracks proximate its rear end and each of said followers has a recess formed therein releasably engaging a respective detent.

6. The book rest of claim 3 wherein each of said tracks terminates at its front end short of the front edge of said opening, said follower slides in the retracted position of said second panel being disposed forwardly of said tracks.

7. The book rest of claim 3 wherein said tracks are below the level of the top faces of said front panel side sections.

8. The book rest of claim 1 including upwardly directed flanges formed along the front edges of said first panel sections.

9. The book rest of claim 1 wherein said first panel opening and said second panel are of similar rectangular configuration.

10. The book rest of claim 1 formed as an integral unit with each of said first, second, third and fourth hinges being self hinges.

11. The book rest of claim 1 wherein in the erected position of said book rest said second panel rear sections are at an acute angle to the plane of said forth hinge and the front edge of said first panel.

12. A collapsible book rest comprising a book supporting platform member having an opening formed therein and divided by a medial longitudinally extending self hinge into opposite side panels swingable about said self hinge between an open position wherein said sections are coplanar and a closed position wherein said sections overlap, a prop member connected by a self hinge to the rear edge of said opening and swingable between an advanced position depending from said platform and a retracted position registering with said opening and locking means releasably retaining said platform member and prop member in their open and advanced positions respectively.

13. The book rest of claim 12 wherein said platform member comprises a panel divided by said medial self hinge into similarly shaped side sections, said opening is of rectangular configuration and transversely medially located in said panel and said prop member is of rectangular configuration and joined to said opening rear edge by a transverse self hinge and divided into end to end and side by side section by a longitudinally extending medial self hinge and a transversely extending self hinge.

* * * * *